US006058954A

United States Patent [19]

Glover et al.

[11] Patent Number: 6,058,954

[45] Date of Patent: May 9, 2000

[54] SUPPLY AND COLLECTION OF SOLUTIONS

[75] Inventors: Edward Charles Glover, London; Anthony Earle, Harrow Weald; Christopher Barrie Rider, New Malden, all of United Kingdom

[73] Assignee: Eastman Kodak Company, Rochester, N.Y.

[21] Appl. No.: 08/642,729

[22] Filed: May 3, 1996

[30] Foreign Application Priority Data

May 4, 1995 [GB] United Kingdom ..... 9509121

[51] Int. Cl.[7] ..... G03D 3/02

[52] U.S. Cl. ..... 137/1; 137/256; 396/626

[58] Field of Search ..... 137/1, 256, 255; 396/630, 626, FOR 942; 206/501

[56] References Cited

U.S. PATENT DOCUMENTS

| | | | |
|---|---|---|---|
| 4,197,942 | 4/1980 | Gacki et al. . | |
| 4,329,042 | 5/1982 | Libicky et al. | 396/626 X |
| 4,480,901 | 11/1984 | Osegowitsch et al. | 396/626 X |
| 4,519,690 | 5/1985 | Tomisawa et al. | 396/626 X |
| 5,199,594 | 4/1993 | Obara et al. . | |
| 5,298,932 | 3/1994 | Twist | 396/626 X |
| 5,353,085 | 10/1994 | Kurematsu et al. . | |
| 5,506,652 | 4/1996 | Gogle et al. | 396/626 X |

FOREIGN PATENT DOCUMENTS

| | | |
|---|---|---|
| 0 227 358 B1 | 12/1986 | European Pat. Off. . |
| 0 276 994 | 1/1988 | European Pat. Off. . |
| 0 500 371 A2 | 2/1992 | European Pat. Off. . |
| 2647919 | 5/1990 | France . |
| U-86 20 048 | 8/1987 | Germany . |
| 1363136 | 8/1970 | United Kingdom . |

*Primary Examiner*—Kevin Lee
*Attorney, Agent, or Firm*—Charles E. Snee, III; Gordon M. Stewart

[57] ABSTRACT

It is known to supply solution to a process and to collect effluent therefrom using 'bag-in-box' arrangement each having a predetermined volume. However, if the process must be supplied with greater volumes of solution, the use of larger 'bag-in-box' arrangements is limited by weight restrictions that an operator can handle. Described herein is a method of using a number of 'bag-in-box' arrangements coupled together to provide a larger volume of replenisher solution to a process and to collect of effluent therefrom than would be the case if only a single 'bag-in-box' arrangement is used. An automatic changeover system can be utilised which allows the process to be supplied with a greater volume of solution than that which corresponds to the legal weight limit without having to empty the supply 'bag-in-box' arrangements into a large replenisher tank.

20 Claims, 1 Drawing Sheet

SUPPLY AND COLLECTION OF SOLUTIONS

FIELD OF THE INVENTION

The present invention relates to improvements in or relating to the supply and collection of solutions, and is more particularly, although not exclusively, concerned with a method of connecting more than one supply and/or collection container to a photographic process for supplying solution to and/or collecting solution from the photographic process.

BACKGROUND OF THE INVENTION

It is known to supply processing solutions to a photographic process using a flexible bag having two compartments each having a port connected thereto. One of the compartments contains processing solution for supplying to a photographic process and the other is empty and is designed to receive used processing solution. Such an arrangement is described in FR-A-2 647 919.

It is also known to supply processing solutions from 'bag-in-box' arrangements which comprise an outer liquid-tight container or box inside which a flexible bag containing processing solution is located. The arrangement has two connections—a first connection between the flexible bag and the outside of the container, and a second connection between the outside of the container and the space between the flexible bag and the outer container. Processing solution is fed from the bag via the first connection to an appropriate photographic process, and used processing solution is returned to the container from the process through the second connection. This means that processing solution can be stored in a container, supplied to a process from that container, and returned thereto when used or exhausted for disposal. Such an arrangement is described in GB-A-1 363 136.

Other 'bag-in-box' arrangements are also described in EP-A-0 284 024 and EP-A-0 227 358.

In the flexible bag arrangement and the 'bag-in-box' arrangements described above, at least two connections are provided, one connection through which solution is supplied to the process and one connection through which used or waste solution is collected therefrom.

Other 'bag-in-box' arrangements are known, for example, as described in EP-A-0 500 371, which utilise a single connector between the inner flexible bag and the exterior of the container, the solution being removed from and returned to the inner flexible bag through the single connector.

Problem to be solved by the Invention

In a photographic process where processing solution is supplied from a 'bag-in-box' arrangement or other flexible container at working strength, large volumes of processing solution will be required when large amounts of material need to be processed so that the process can be run continuously. Theoretically, this can be done by having suitably sized 'bag-in-box' arrangements and other flexible containers.

However, as the volume of the 'bag-in-box' arrangement or other flexible container increases so does its weight, and there are limits to the weight which an operator is allowed to handle when changing the 'bag-in-box' arrangements or other flexible containers. This weight restriction severely limits the size of the 'bag-in-box' arrangement or other flexible container which can be used both to supply the process and to collect effluent therefrom.

SUMMARY OF THE INVENTION

It is therefore an object of the present invention to provide an arrangement where volumes of solution can be supplied to and collected from a process without the weight disadvantages mentioned above.

In accordance with one aspect of the present invention, there is provided a method of supplying solution to a process using flexible containers, each flexible container containing solution of a predetermined volume, characterized in that a plurality of flexible containers are connected to supply the process with a volume of solution which is greater that the volume of solution contained in each individual flexible container.

The plurality of flexible containers may be connected together so that each flexible container supplies the process simultaneously. Alternatively, the plurality of flexible containers may be connected together by means of a valve which switches between flexible containers as each one is emptied.

The valve may comprise a fully automatic valve which operates independently of control means for the process. Alternatively, the valve may comprise a semi-automatic valve which is operated by an external signal generated by control means for the process. The valve may also be manually operated in response to a signal generated by control means for the process.

Each emptied flexible container is used for collecting effluent from the process. In one embodiment, the flexible containers are stacked so that the lowest flexible container fills first, and when full, is removed for disposal.

In accordance with a second aspect of the present invention, there is provided a method for supplying solution to a process and collecting effluent therefrom, the process having an inlet side to which solution is supplied and an outlet side from which effluent is collected, solution being supplied from a plurality of flexible containers each containing solution of a predetermined volume, characterized in that on the outlet side, empty flexible containers are connected thereto, each empty flexible container being stacked one above another, as each flexible container becomes emptied on the inlet side of the process it is disconnected therefrom and replaced with a flexible container full of solution, a full flexible container on the outlet side is disconnected therefrom and removed for disposal, any partially full flexible container on the outlet side of the process is moved downwards to take the position of the removed flexible container and the emptied flexible container is connected to the outlet side of the process.

In another embodiment, a plurality of flexible containers are connected to collect effluent from the process by means of a valve which switches between flexible containers as each one becomes full.

In accordance with a third aspect of the present invention, there is provided a method for supplying solution to a process and collecting effluent therefrom, the process having an inlet side to which solution is supplied and an outlet side from which effluent is collected, solution being supplied from a plurality of flexible containers each containing solution of a predetermined volume, characterized in that on the inlet side, a plurality of full flexible containers are connected to thereto by means of a valve which switches between an empty flexible container to a full flexible container to maintain a continuous supply of solution to the process, and in that on the outlet side, a plurality of empty flexible containers are connected thereto by means of a valve which operates to allow each empty flexible container to be filled and then switches between a full flexible container and an empty flexible container, each flexible container emptied on the inlet side of the process being disconnected therefrom and replaced with a new flexible container full of solution, each full flexible container on the outlet side being disconnected therefrom and removed for disposal, emptied flexible containers from the inlet side being connected to the outlet side of the process.

By the term 'flexible container' is meant any sealed container where no air enters as solution is withdrawn therefrom or added thereto. This includes, in particular, 'bag-in-box' arrangements which comprise an outer liquid-tight container inside which a flexible bag is located.

Advantageous Effect of the Invention

Advantageously, by coupling up or connecting two or more flexible containers, particularly, 'bag-in-box' arrangements together to effect replenishment, that is, on the inlet side to a process and/or to collect effluent, that is, on the outlet side of the process, the process itself can be operated as though it has a large replenishment volume and/or an equal or larger collection volume for effluent by having a number of flexible containers or 'bag-in-box' arrangements each falling within the allowable weight limit which can be handled by an operator. For example, solution can be supplied in a 10 liter 'bag-in-box' arrangements and by appropriate connections, volumes of 20 liters, 30 liters or even 40 liters can be supplied to the process. Similarly, on the outlet side of the process, volumes of 20 to 40 liters can be collected in 10 liter flexible containers or 'bag-in-box' arrangements.

Moreover, the present invention can also allow operator-free working, for example, at night when the amount of material to be processed is known and an appropriate number of flexible containers or 'bag-in-box' arrangements can be connected together.

Alternatively, the operator can change each flexible container or 'bag-in-box' arrangement as it becomes empty without interrupting the supply of solution to the process or collection of effluent therefrom during the changeover time, more time being provided to effect the changeover of flexible containers or 'bag-in-box' arrangements.

BRIEF DESCRIPTION OF THE DRAWINGS

For a better understanding of the present invention, reference will now be made, by way of example only, to the accompanying drawing, in which:—

The FIGURE illustrates a process to which solution is supplied and from solution is collected in flexible containers or 'bag-in-box' arrangements connected in accordance with the present invention.

DETAILED DESCRIPTION OF THE INVENTION

Figure 1:
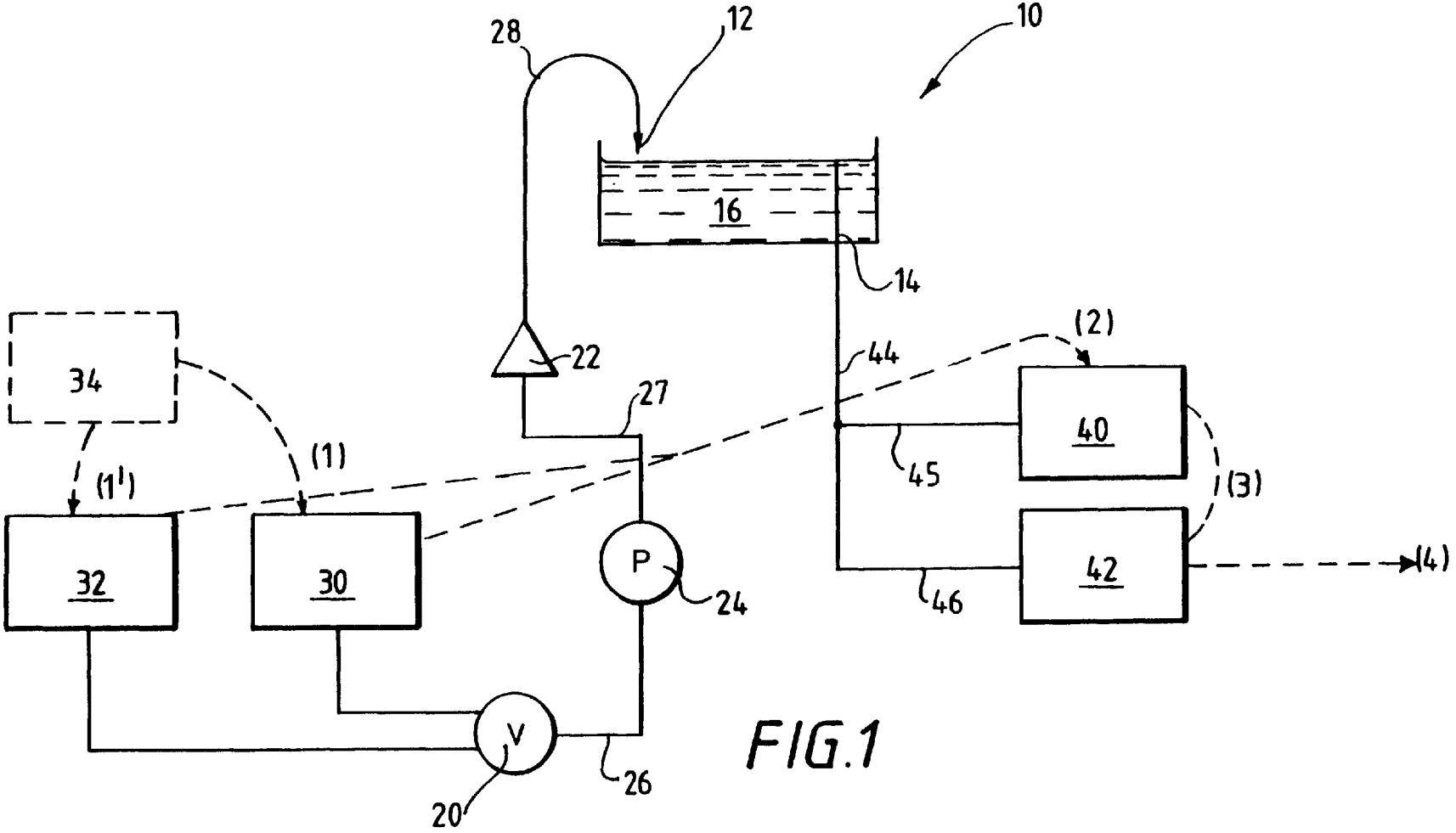

Our co-pending, commonly assigned U.S. patent application no. 08/632,992 (corresponding to British patent application no. 9507845.7 filed on Apr. 18, 1995), incorporated herein by reference, describes a process to which solution is supplied from flexible containers or 'bag-in-box' arrangements, and effluent from the process is collected in flexible containers or 'bag-in-box' arrangements. A valve arrangement is utilised which switches the connections between the inlet and outlet side of the process so that flexible containers or 'bag-in-box' arrangements are alternatively removed and replaced on the two sides of the process.

The present invention is applicable to flexible containers as described above, and will be described in more detail with reference to 'bag-in-box' arrangements, each having a self-sealing, dry-break connector through which fluid connection is made. However, it will be readily appreciated that the present invention is not limited to use with such 'bag-in-box' arrangements.

The FIGURE schematically illustrates a process tank 10 having an inlet 12 and an outlet 14, the process tank 10 containing processing solution 16.

The inlet 12 of the process tank 10 is connected to a valve 20 by way of flow meter 22 and pump 24 as shown, conduits 26, 27, 28 providing the respective connections between valve 20 and pump 24, between pump 24 and flow meter 22 and between flow meter 22 and inlet 12.

The outlet 14 of the process tank 10 is connected to two 'bag-in-box' arrangements 40, 42 by means of conduits 44, 45, 46 as shown.

'Bag-in-box' arrangement 30 is connected for supplying the process tank 10 via valve 20, 'bag-in-box' arrangement 32 being on 'stand-by'—ready for connection to the inlet 12 of the process tank 10 when 'bag-in-box' arrangement 30 becomes empty. As shown, 'bag-in-box' arrangement 32 is positioned adjacent 'bag-in-box' arrangement 30. However, this need not be the case, and the two 'bag-in-box' arrangements can be stacked one on top of the other (not shown).

Valve 20 may be, in the simplest mode, a T-piece providing the connection between conduit 26 and 'bag-in-box' arrangements 30, 32. In this mode, both 'bag-in-box' arrangements 30, 32 will be connected in order to supply solution to the inlet 12 of the process tank 10, and both tanks will empty simultaneously at a substantially similar rate. In this case, a signal is only produced when the flow meter 22 gives a low flow reading, indicating that more replenisher solution is required, that is, the 'bag-in-box' arrangements need to be replaced.

If this signal is generated whilst processing of a large amount of material, a very quick change of the 'bag-in-box' arrangements would be required which may be problematic—especially, if an operator is not in the vicinity of the process at that particular time.

Furthermore, this may not be satisfactory if the volume of solution required by the process is more than that contained in two 'bag-in-box' arrangements as both 'bag-in-box' arrangements will need changing at substantially the same time for processing to be continued.

This problem may be overcome by utilising a buffer device as described in our co-pending, commonly assigned U.S. patent application Ser. No. 08/633,146 (corresponding to British application no. 9507846.5), which is incorporated herein by reference. The buffer device allows the process tank to be supplied with solution for a predetermined time, even though the 'bag-in-box' arrangement supplying it has been emptied. This enables the empty 'bag-in-box' arrangement to be disconnected from the inlet side of the process and re-connected to the outlet side thereof for collection of the effluent from the process.

Alternatively, the valve 20 may comprise a cross-over valve. In this case, the valve 20 switches between 'bag-in-box' arrangement 30 and 'bag-in-box' arrangement 32 when 'bag-in-box' arrangement 30 becomes empty. 'Bag-in-box' arrangement 32 can then be disconnected from the inlet side of the process and re-connected to the outlet side for collection of the effluent as will be described in detail later. A new 'bag-in-box' arrangement 34, shown in dotted lines, is then connected to the inlet side of the process in place of 'bag-in-box' arrangement 30.

The cross-over valve may be:— a) fully automatic, requiring no external signal input to initiate its operation, the valve switching in response to pressure in the 'bag-in-box' arrangement (or lack of it due to pump 24) to which it is connected;

b) semi-automatic, requiring an external signal to initiate its operation, the external signal being generated by control means (not shown) for the process in response to, for example, flow measurement through flow meter 22; and c) manually operated in response to an alarm signal generated by control means (not shown) connected for the process in accordance with, for example, flow measurement through flow meter 22.

The fully automatic cross-over switch in a) above can be described as a 'passive' switch and does not need an external signal to operate it. For example, referring to the Figure, if 'bag-in-box' arrangement 30 is connected for supplying the process via the switch, and 'bag-in-box' arrangement 32 is also connected thereto but not actually in use, when 'bag-in-box' arrangement 30 becomes empty, the suction on the delivery pipe increases (that is, the actual pressure becomes less). This action causes the switch to switch from 'bag-in-box' arrangement 30 to 'bag-in-box' arrangement 32. In this way, the process will operate normally. A control system (not shown) can be arranged to sense this action and generate an alarm signal to alert an operator that 'bag-in-box' arrangement 30 (which is now empty) needs to be changed for a new full one, and that 'bag-in-box' arrangement 30 is to be moved to the outlet side of the process for collection of effluent. The alarm signal can be in any suitable form, for example, it may audible and/or visual.

The semi-automatic cross-over valve in b) above is operated by sensing when 'bag-in-box' arrangement 30 becomes empty by measuring solution flow through flow meter 22. A signal is generated by control means (not shown) to initiate operation of the valve 20 to switch over to 'bag-in-box' arrangement 32 from 'bag-in-box' arrangement 30. The same signal can be used to alert an operator that the 'bag-in-box' arrangements need replacement/changing and that the solution will run out, either in accordance with a given time or with a given surface area of material processed. 'Bag-in-box' arrangement 32 continues to supply the inlet of the process until it too becomes empty, and then the valve 20 switches to 'bag-in-box' arrangement 34 which replaces 'bag-in-box' arrangement 30.

For manual operation as described in c) above, an operator has to effect the switching between the empty 'bag-in-box' arrangement and a full 'bag-in-box' arrangement. However, the valve may include detecting means for detecting, for example, a change in pressure, that is, an increase in negative pressure due to suction on the empty 'bag-in-box' arrangement, the detecting means operating to provide a signal to alert the operator that the switching has to be effected.

In both a) and b) above, the valve 20 continues to switch between the 'bag-in-box' arrangements on the inlet side of the process, located in the positions shown by 'bag-in-box' arrangements 30, 32 in the FIGURE, as long as solution is required by the process.

On the outlet side of the process tank 10, as shown in the Figure, 'bag-in-box' arrangement 40, 42 are both connected to the outlet 14 at the same time. As shown, 'bag-in-box' arrangement 40 is shown stacked on top of 'bag-in-box' arrangement 42. This means that 'bag-in-box' arrangement 42 will fill first, under the influence of gravity, and then once full, 'bag-in-box' arrangement 40 will then fill.

Once 'bag-in-box' arrangement 42 is full, it is disconnected from the outlet side of the process and removed for disposal. 'Bag-in-box' arrangement 40 is then moved down to the position previously occupied by 'bag-in-box' arrangement 42 and it is then replaced with empty 'bag-in-box', arrangement 30 which was disconnected from the inlet side of the process. Once 'bag-in-box' arrangement 40 becomes full, it is removed, 'bag-in-box' arrangement 30 is moved down and replaced by an empty 'bag-in-box' arrangement from the inlet side.

Generally, a 'bag-in-box' arrangement moves as shown by the dotted lines in the Figure and follows the following steps:— i) a new 'bag-in-box' arrangement full of solution is connected to the inlet side of the process as shown by either arrow (1) or (1');

ii) the emptied 'bag-in-box' arrangement is disconnected from the inlet side and connected to the outlet side of the process as shown by arrow (2);

iii) the partially full 'bag-in-box' arrangement on the outlet side of the process is moved downwards as shown by arrow (3); and iv) the full 'bag-in-box' arrangement on the outlet side is removed for disposal as shown by arrow (4).

Whenever a 'bag-in-box' arrangement connected to the outlet side is to be changed, it is always the lower one that is removed, because it will always be the fullest due to the effects of gravity.

Instead of having the 'bag-in-box' arrangements on the outlet side of the process connected as described above with reference to the Figure, a valve similar to valve 20 operating in a manual, semi- or fully automatic mode can be utilised. In this case, the valve can be pressure-operated to switch between a full 'bag-in-box' arrangement and an empty 'bag-in-box' arrangement.

Each 'bag-in-box' arrangement is designed to be able to contain a volume of solution which allows it to be within the weight limit restrictions, for example, less than 10 liters.

We claim:

1. A method of supplying solution to a process using flexible containers, each flexible container containing the same processing solution of a predetermined volume, wherein a plurality of flexible containers are connected to provide the process with a volume of solution which is greater than the volume of solution contained in each individual flexible container, the plurality of flexible containers being connected together by means of a valve which switches between flexible containers as each one is emptied.

2. The method according to claim 1, wherein the valve comprises a fully automatic valve which operates independently of control means for the process.

3. The method according to claim 1, wherein the valve comprises a semi-automatic valve which is operated by an external signal generated by control means for the process.

4. The method according to claim 1, wherein the valve is manually operated in response to a signal generated by control means for the process.

5. The method according claim 1, wherein each flexible container comprises a 'bag-in-box' arrangement comprising an outer liquid-tight container inside which a flexible bag is located.

6. The method according to claim 5, wherein the 'bag-in-box' arrangement includes a self-sealing, dry-break connector.

7. A method of supplying solution to a process using flexible containers, each flexible container containing processing solution of a predetermined volume, wherein a plurality of flexible containers are connected to provide the process with a volume of solution which is greater than the volume of solution contained in each individual flexible container, and wherein:

the plurality of the flexible containers are connected together by means of a valve which switches between flexible containers as each one is emptied; and wherein the valve is manually operated and includes detecting means for detecting a change in pressure and operates to provide a signal to alert an operator to effect switching.

8. A method of supplying solution to a process using flexible containers, each flexible container containing processing solution of a predetermined volume, wherein a plurality of flexible containers are connected to provide the process with a volume of solution which is greater than the volume of solution contained in each individual flexible container;

and wherein additional flexible containers are used for collecting effluent from the process, the flexible containers being stacked so that the lowest flexible container fills first, and when full, is removed for disposal.

9. A method of supplying solution to a process using flexible containers, each flexible container containing processing solution of a predetermined volume, wherein a plurality of flexible containers are connected to provide the process with a volume of solution which is greater than the volume of solution contained in each individual flexible container:

and wherein a plurality of flexible containers are connected to collect effluent from the process by means of a valve which switches flexible containers as each one becomes full.

10. A method for supplying solution to a process and collecting effluent therefrom, the process having an inlet side to which solution is supplied and an outlet side from which effluent is collected, solution being supplied from a plurality of flexible containers each containing solution of a predetermined volume, wherein on the outlet side, empty flexible containers are connected thereto, each empty flexible container being stacked one above another, as each flexible container becomes emptied on the inlet side of the process it is disconnected therefrom and replaced with a new flexible container full of solution, a full flexible container on the outlet side is disconnected therefrom and removed for disposal, any partially full flexible container on the outlet side of the process is moved downwards to take the position of the removed flexible container and the emptied flexible container is connected to the outlet side of the process.

11. The method according claim 10, wherein each flexible container comprises a 'bag-in-box' arrangement comprising an outer liquid-tight container inside which a flexible bag is located.

12. The method according to claim 11, wherein the 'bag-in-box' arrangement includes a self-sealing, dry-break connector.

13. A method for supplying solution to a process and collecting effluent therefrom, the process having an inlet side to which solution is supplied and an outlet side from which effluent is collected, solution being supplied from a plurality of flexible containers each containing solution of a predetermined volume, wherein on the inlet side, a plurality of full flexible containers are connected thereto by means of a valve which switches between an empty flexible container to a full flexible container to maintain a continuous supply of solution to the process, and in that on the outlet side, a plurality of empty flexible containers are connected thereto by means of a valve which operates to allow each empty flexible container to be filled and then switches between a full flexible container and an empty flexible container, each flexible container emptied on the inlet side of the process being disconnected therefrom and replaced with a new flexible container full of solution, each full flexible container on the outlet side being disconnected therefrom and removed for disposal, emptied flexible containers from the inlet side being connected to the outlet side of the process.

14. The method according claim 13, wherein each flexible container comprises a 'bag-in-box' arrangement comprising an outer liquid-tight container inside which a flexible bag is located.

15. The method according to claim 14, wherein the 'bag-in-box' arrangement includes a self-sealing, dry-break connector.

16. The method according to claim 13, wherein the valve which switches between an empty flexible container to a full flexible container comprises a fully automatic valve which operates independently of control means for the process.

17. The method according to claim 13, wherein the valve which switches between an empty flexible container to a full flexible container comprises a semi-automatic valve which is operated by an external signal generated by control means for the process.

18. The method according to claim 13, wherein the valve which switches between an empty flexible container to a full flexible container is manually operated in response to a signal generated by control means for the process.

19. The method according to claim 13, wherein the valve which switches between an empty flexible container to a full flexible container is manually operated and includes detecting means for detecting a change in pressure and operates to provide a signal to alert an operator to effect switching.

20. A method of collecting effluent from a process, comprising using flexible containers for collecting the effluent from the process, the flexible containers being stacked so that the lowest flexible container fills first, and when full, is removed for disposal.

* * * * *